US005769776A

United States Patent [19]

Leung et al.

[11] Patent Number: 5,769,776

[45] Date of Patent: Jun. 23, 1998

[54] FEED ACCELERATOR SYSTEM INCLUDING ACCELERATING VANE APPARATUS

[75] Inventors: Wallace Woon-Fong Leung, Sherborn; Ascher H. Shapiro, Jamaica Plain, both of Mass.

[73] Assignee: Baker Hughes Incorporated, Houston, Tex.

[21] Appl. No.: 689,370

[22] Filed: Aug. 8, 1996

Related U.S. Application Data

[62] Division of Ser. No. 481,043, Jun. 7, 1995, Pat. No. 5,551,943, which is a continuation of Ser. No. 110,324, Aug. 20, 1993, which is a continuation of Ser. No. 815,432, Dec. 31, 1991, abandoned.

[51] Int. Cl.[6] ..... B04B 1/20

[52] U.S. Cl. ..... 494/53

[58] Field of Search ..... 494/50, 52–55; 210/380.1, 380.3

[56] References Cited

U.S. PATENT DOCUMENTS

| | | | |
|---|---|---|---|
| 2,703,676 | 3/1955 | Gooch | 494/53 |
| 3,368,747 | 2/1968 | Lavanchy | 494/53 |
| 3,568,920 | 3/1971 | Nielson | 494/53 |
| 4,142,669 | 3/1979 | Burlet | 494/53 |
| 4,245,777 | 1/1981 | Lavanchy | 494/53 |

FOREIGN PATENT DOCUMENTS

| | | | |
|---|---|---|---|
| 3723864 | 1/1989 | Germany | 494/53 |

*Primary Examiner*—Terrence Till
*Attorney, Agent, or Firm*—Cesari and McKenna, LLP

[57] ABSTRACT

A feed accelerator system for use in a centrifuge, the system comprising a conveyor hub rotatably mounted within a rotating bowl, the hub including an inside surface and an outside surface. At least one feed slurry passageway is disposed between the inside surface of conveyor hub and the outside surface of the conveyor hub, and at least one helical blade having a plurality of turns is mounted to the outside surface of the conveyor hub. A vane apparatus is associated with the passageway and is disposed between two adjacent turns of the helical blade. The vane apparatus may include an inwardly extending baffle and/or an outwardly extending accelerator vane. Alternatively, a U-shaped channel may be associated with the passageway, the U-shaped channel including a plurality partitions attached to the discharge end of such channel so as to form a plurality of discharge channels and a flow directing and overspeeding vane disposed within each channel, each vane having a different forward discharge angle.

4 Claims, 13 Drawing Sheets

FEED ACCELERATOR SYSTEM INCLUDING ACCELERATING VANE APPARATUS

This is a divisional of application Ser. No. 08/481,043 filed on Jun. 7, 1995 now U.S. Pat. No. 5,551,943, which is a continuation of Ser. No. 08/110,324, filed Aug. 20, 1993, which is a continuation of Ser. No. 07/815,432 and filed on Dec. 31, 1991 now abandoned.

BACKGROUND OF THE INVENTION

Conventional sedimentation or filtration systems operating under natural gravity have a limited capacity for separating a fluid/particle or fluid/fluid mixture, otherwise known as a feed slurry, having density differences between the distinct phases of the slurry. Therefore, industrial centrifuges that produce large centrifugal acceleration forces, otherwise known as G-levels, have advantages and thus are commonly used to accomplish separation of the light and heavy phases. Various designs of industrial centrifuges include, for example, the decanter, screen-bowl, basket, and disc centrifuge.

Industrial centrifuges rotate at very high speeds in order to produce large centrifugal acceleration forces. Several problems arise when the feed slurry is introduced into the separation pool of the centrifuge with a linear circumferential speed less than that of the centrifuge bowl.

First, the centrifugal acceleration for separation is not fully realized. The G-level might be only a fraction of what is possible. The G-level is proportional to the square of the effective acceleration efficiency. The latter is defined as the ratio of the actual linear circumferential speed of the feed slurry entering the separation pool to the linear circumferential speed of the rotating surface of the separation pool. For example, if the acceleration efficiency is 50 percent, the G-level is only 25 percent of what might be attained and the rate of separation is correspondingly reduced.

Second, the difference in circumferential linear speed, between the slurry entering the separation pool and the slurry within the separation pool which has been fully accelerated by the rotating conveyor and bowl, leads to undesirable slippage, otherwise known as velocity difference, and this creates turbulence in the slurry lying within the separation pool. Such turbulence results in resuspension of the heavy phase, equivalent to a remixing of the heavy phase material and the lighter phase material.

Third, because a portion of the separation pool is used to accelerate the feed slurry, the useful volume of the separation pool is reduced, and thus the separation efficiency of the centrifuge is lessened.

Fourth, the feed slurry often exits the feed accelerator and enters the separation pool of the centrifuge in a non-uniform flow pattern, such as in concentrated streams or jets, which causes remixing of the light and heavy phases within the separation pool.

These problems are common in decanter centrifuges generally including a rotating screw-type conveyor mounted substantially concentrically within a rotating bowl. The conveyor usually includes a helical blade disposed on the outside surface of a conveyor hub, and a feed distributor and accelerator positioned within the conveyor hub. A feed slurry is introduced into the conveyor hub by a feed pipe, engages the feed distributor and accelerator, and then exits the conveyor hub through at least one passageway between the inside and outside surfaces of the conveyor hub. Normally the feed slurry exits through the passageway at a circumferential speed considerably less than that of the separation pool surface, thus creating the aforementioned problems. Therefore, it is desirable to incorporate feed slurry accelerator enhancements into the passageway so that the acceleration and separation efficiency of the centrifuge may be increased.

SUMMARY OF THE INVENTION

The centrifuge feed accelerator system of the invention comprises a conveyor hub rotatably mounted substantially concentrically within a rotating bowl, the hub including an inside surface and an outside surface. At least one helical blade having a plurality of turns is mounted to the outside surface of the conveyor hub. An accelerator is secured within the conveyor and includes a distributor having a distributor surface. A feed pipe mounted substantially concentrically within the conveyor hub delivers a feed slurry to the centrifuge and includes a discharge opening positioned proximate to the distributor surface.

At least one feed slurry passageway is disposed between the inside surface of conveyor hub and the outside surface of the conveyor hub. In the preferred embodiment, a vane apparatus is associated with each passageway and is disposed between two adjacent turns of the helical blade. The vane apparatus may include a baffle extending radially inward into a slurry pool formed by the feed slurry on the inside surface of the conveyor hub and/or an accelerator vane oriented approximately parallel to the axis of rotation, extending outwardly from the passageway, and disposed between two adjacent turns of the helical blade. The accelerator vane extends outwardly from the passageway proximate to a surface of a separation pool located in a zone formed between the conveyor hub and the bowl. Alternatively, the accelerator vane may extend outwardly from the passageway into a separation pool located in a zone formed between the conveyor hub and the bowl. In the preferred embodiment, the baffle and the accelerator vane are integral with one another, and the accelerator vane is forwardly curved in the direction of rotation of the conveyor hub.

The feed accelerator system including the aforementioned vane apparatus may also include a flow guiding skirt disposed circumferentially about the conveyor hub and attached to a first turn of the helical blade at an angle. A smoothener apparatus is also disposed circumferentially about the conveyor hub and is attached to a second turn of the helical blade adjacent to the first turn at an angle so that feed slurry exiting the vane apparatus is directed onto the smoothener apparatus by the flow guiding skirt. Any concentrated streams or jets of feed slurry exiting the vane apparatus are smeared out by the smoothener apparatus, resulting in circumferentially uniform feed slurry flow into the separation pool formed in the zone between the conveyor hub and the bowl.

In another embodiment of the invention, an outwardly extending U-shaped channel is associated with the passageway. The U-shaped channel includes a discharge end, a plurality of partitions approximately parallel to the axis of rotation and attached to the discharge end so as to form a plurality of discharge channels, and a flow directing and overspeeding vane disposed within each discharge channel, each vane extending circumferentially and radially outward from the discharge end.

Each flow directing and overspeeding vane extending from the discharge end of the U-channel is curved or angled in the direction of rotation of the conveyor hub and includes a different forward discharge angle at its outward end. Thus, the flow directing and overspeeding vanes cause the feed slurry to exit the U-shaped channels at different angles, thus providing a more circumferentially uniform flow of feed slurry into the separation pool.

DESCRIPTION OF THE PREFERRED EMBODIMENT

Figure 1A:
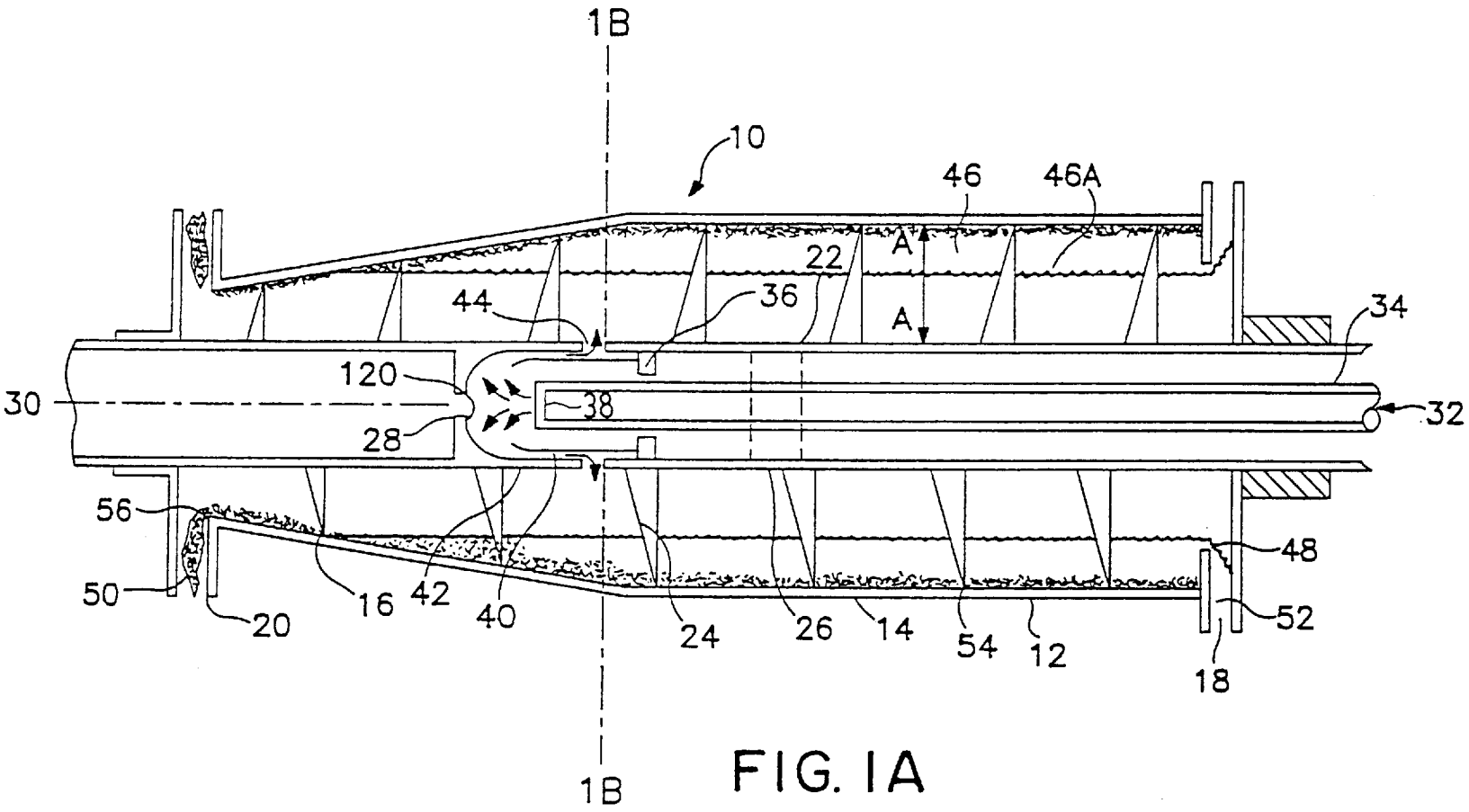
FIG. 1A is a schematic cross-sectional view of a decanter centrifuge.

FIG. 1A shows a decanter centrifuge 10 for separating heavier-phase substances, such as suspended solids, from lighter-phase substances, such as liquids. The centrifuge 10 includes a bowl 12 having a generally cylindrical clarifier section 14 adjacent to a tapered beach section 16, at least one lighter-phase discharge port 18 communicating with the clarifying section 14, and at least one heavier-phase discharge port 20 communicating with the tapered beach section 16. A screw-type conveyor 22 is rotatably mounted substantially concentrically within the bowl 12, and includes at least one helical blade 24 having a plurality of turns disposed about a conveyor hub 26, and a feed distributor and accelerator secured therein, such as a hub accelerator 28 having a distributor surface 120. The bowl 12 and conveyor 22 rotate at high speeds via a driving mechanism (not shown) but at different angular velocities about an axis of rotation 30.

A feed slurry 32 having, for example, solids 50 suspended in liquid 52, is introduced into the centrifuge 10 through a feed pipe 34 mounted within the conveyor hub 26 by a mounting apparatus (not shown). A feed pipe baffle 36 is secured to the inside surface 42 of the conveyor hub 26 to prevent the feed slurry 32 from flowing back along the inside surface 42 of the conveyor hub 26 and the outside surface of the feed pipe 34. In addition, another baffle 36 may be secured to the feed pipe 34. The feed slurry 32 exits the feed pipe 34 through a discharge opening 38, engages the distributor surface 120 of the hub accelerator 28, and forms a slurry pool 40 on the inside surface 42 of the conveyor hub 26. Various hub accelerator 28 designs are known in the industry having as an objective to accelerate the feed slurry 32 in the slurry pool 40 to the rotational speed of the conveyor hub 26.

The feed slurry 32 exits the conveyor hub 26 through at least one passageway 44 formed in the- conveyor hub 26, and enters the zone A—A formed between the conveyor hub 26 and the bowl 12. The feed slurry 32 then forms a separation pool 46 having a pool surface 46A, within the zone A—A. As shown schematically in FIG. 1A, the depth of the separation pool 46 is determined by the radial position of one or more dams 48 proximate to the liquid discharge port 18.

The centrifugal force acting within the separation pool 46 causes the heavier-phase suspended solids or liquids 50 in the separation pool 46 to sediment on the inner surface 54 of the bowl 12. The sedimented solids 50 are conveyed "up" the tapered beach section 16 by the differential rotational speed of the helical blade 24 of the conveyor 22 with respect to that of the bowl 12, then pass over a spillover lip 56 proximate to the solids discharge port 20, and finally exit the centrifuge 10 via the solids discharge port 20. The liquid 52 leaves the centrifuge 10 through the liquid discharge port 18 after flowing over the dam(s) 48. Persons skilled in the centrifuge art will appreciate that the separation of heavier-phase substances from lighter-phase substances can be accomplished by other similar devices.

Conventional feed distributors and accelerators, such as the hub accelerator 28 in FIG. 1A, do not accelerate the feed slurry to the rotational speed of the conveyor hub 26 because the feed slurry 32 contacts the inside surface 42 of the conveyor hub 26 only over a short distance before exiting the conveyor hub 26 through the passageway 44. Even if the feed slurry 32 is accelerated up to the linear circumferential speed of the conveyor hub 26, the speed of the feed slurry 32 as it exits the passageway 44 is less than that of the separation pool surface 46A located at a larger radius from the axis of rotation 30. Therefore, feed slurry acceleration enhancements are required.

Figure 1B:
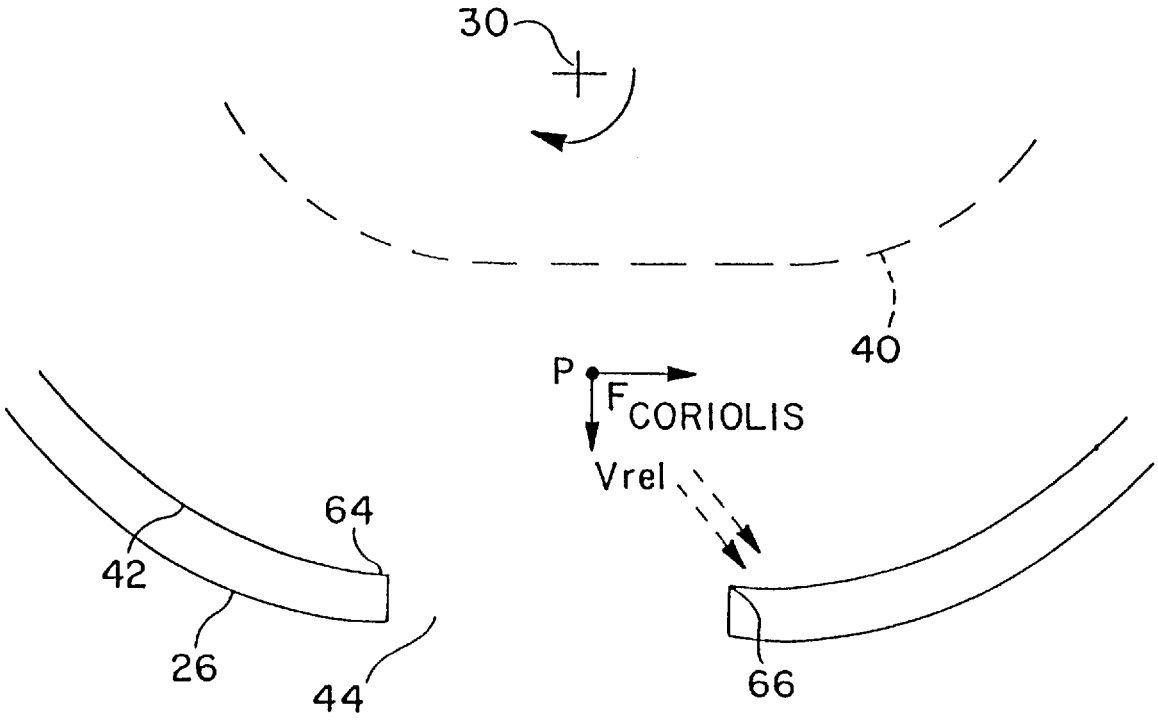
FIG. 1B is a portion of the cross-sectional view of the decanter centrifuge of FIG. 1A along line 1B—1B.

It is well known in the industry that there is a large impedance to the flow of the feed slurry 32 as it exits the conveyor hub 26 through passageways 44. As shown in FIG. 1B, indicating the axis of rotation 30 and the direction of rotation of the conveyor hub 26 as clockwise, a feed slurry particle P approaches the passageway 44 and experiences a relative velocity vector Vrel in the radially outward direction, shown as vertically downward in FIG. 1B. The velocity vector Vre1 induces a Coriolis force perpendicularly to Vrel, acting rightwards as shown in FIG. 1B. The Coriolis force causes a change in the trajectory of particle P from originally moving outward, to moving in both outward and rightwards directions, as shown by the dashed arrows in FIG. 1B. The rightwards directed flow could also be due to slippage of the feed slurry 32 in the circumferential direction with respect to the hub 26. In any case, this direction of flow further induces a radially inward Coriolis force which impedes the flow of slurry through passageway 44.

Figure 2A:
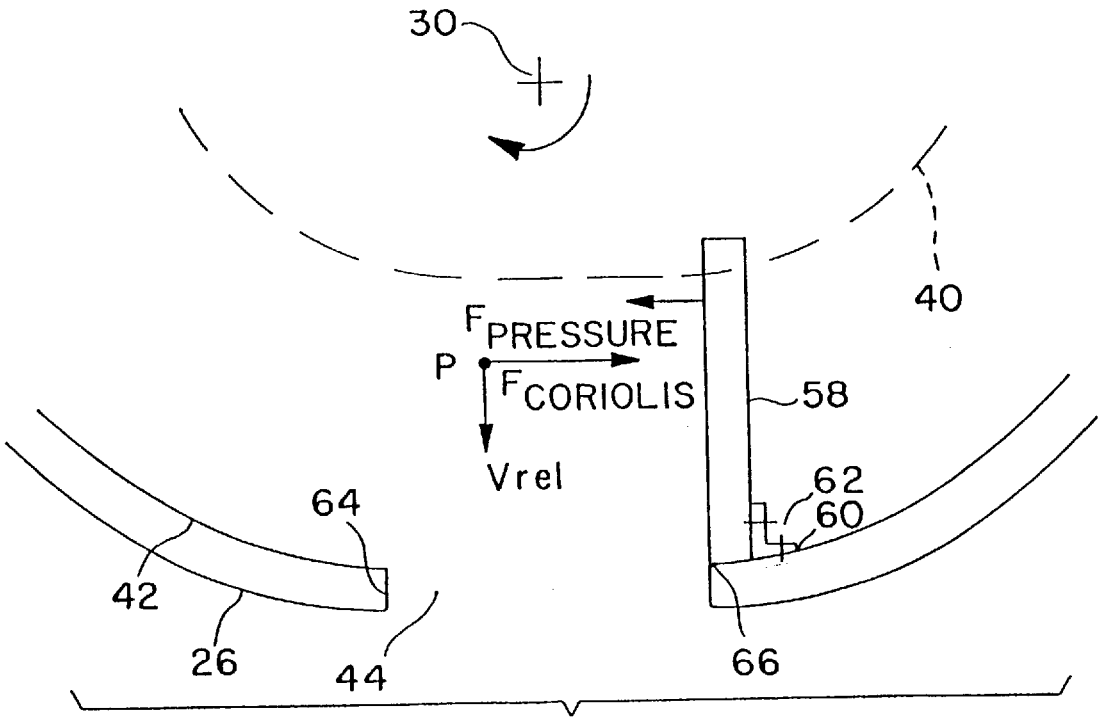
FIG. 2A is a cross-sectional view of an inwardly extending baffle.

As shown in FIG. 2A, the undesirable effect of the Coriolis force can be eliminated by the use of a baffle 58 associated with the trailing edge 66 of the passageway 44 and extending inwardly into the conveyor hub 26 primarily in the radial direction. The inwardly extending baffle 58 is oriented to produce a pressure gradient force acting leftwards, as shown in FIG. 2A, which balances the Coriolis force, with the consequence that the previously stated impedance to flow through the passageway 44 is eliminated. Thus, the feed slurry flow in the outwardly direction does not require an excessive depth of the slurry pool 40 to be formed on the inside surface 42 of the conveyor hub 26.

Figure 2B:
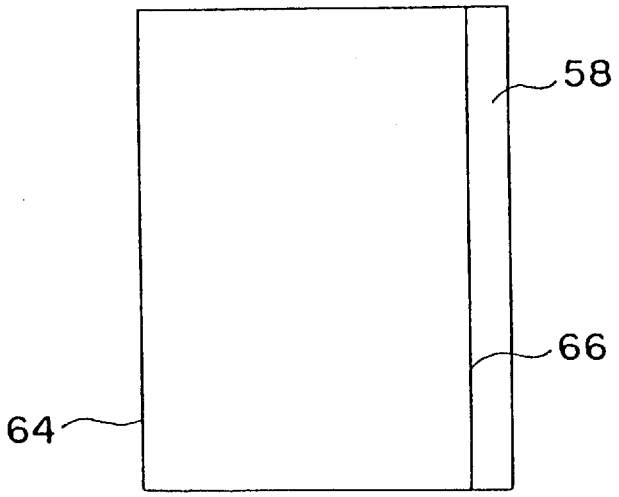
FIG. 2B is a radial view of the inwardly extending baffle of FIG. 2A.
Figure 7A:
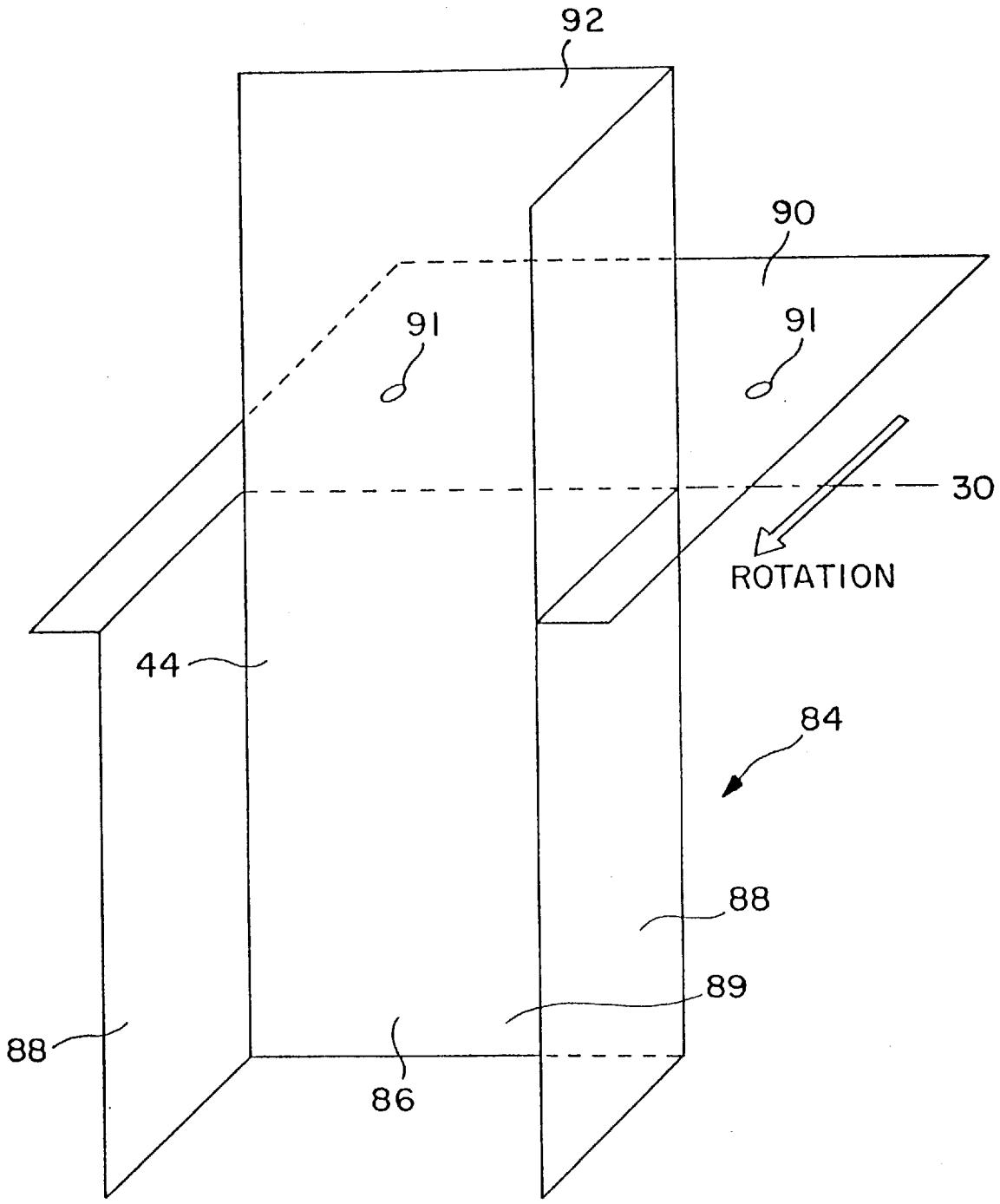
FIG. 7A is a perspective view of a U-shaped channel.

As shown in FIG. 2A, the baffle 58 is secured to the trailing edge 66 by a fastener assembly, such as a bracket 60 and screws 62. The baffle 58 is shown in FIG. 2A as extending beyond the slurry pool 40 but may end within the slurry pool 40. The baffle 58 may also be curved or L-shaped in a direction perpendicular to the axis of rotation 30, as shown in FIG. 7A and more fully described below, so as to direct the feed slurry 32 into the passageway 44. In the preferred embodiment, the passageway 44 has a longer axis approximately parallel to the axis of rotation 30 and the baffle 58 is positioned approximately parallel to the axis of rotation 30, as shown in FIG. 2B. The passageway may be of rectangular or oval shape. Alternatively, the passageway 44 may have a longer axis approximately in the circumferential direction.

A feed accelerator system similar to that of FIG. 2A was tested in an experimental rig to study the effectiveness of the baffle 58 as shown in FIG. 2A. In the experimental rig, the conveyor hub 26 included inner and outer diameters of 8.125 inches and 9.80 inches, respectively. The inside diameter of the feed pipe was 2.3 inches. The distance from the distributor surface 120 of the hub accelerator 28 to the feed pipe discharge opening 38 was 7.7 inches and the distance from the distributor surface 120 to the baffle 36 was 10.75 inches. Four passageways 44 were positioned 90 degrees apart in the wall of conveyor hub 26, each passageway 44 having a rectangular cross-section, with the dimensions of 3 inches parallel to the axis of rotation 30 and 2 inches circumferentially.

Experiments were performed at conveyor hub rotative speeds of approximately 2000 revolutions per minute, and with a flow rate of feed slurry 32 (modelled by water) of 400 gallons per minute. Without a baffle 58 associated with each passageway 44, the accelerator efficiency of the centrifuge was determined to be 50 percent. A baffle 58 having a height of 1.5 inches relative to inside surface 42 of conveyor hub 26 was installed in each passageway 44 in the orientation shown in FIGS. 2A and 2B. Test results indicate that the acceleration efficiency was increased from the aforementioned 50 percent to 88 percent. This increase in acceleration efficiency is the result of an increase in the swallowing capacity of passageway 44 for the feed slurry 32, and was accompanied by a reduction of backflow of the feed slurry 32 past feed pipe baffle 36.

Figure 3A:
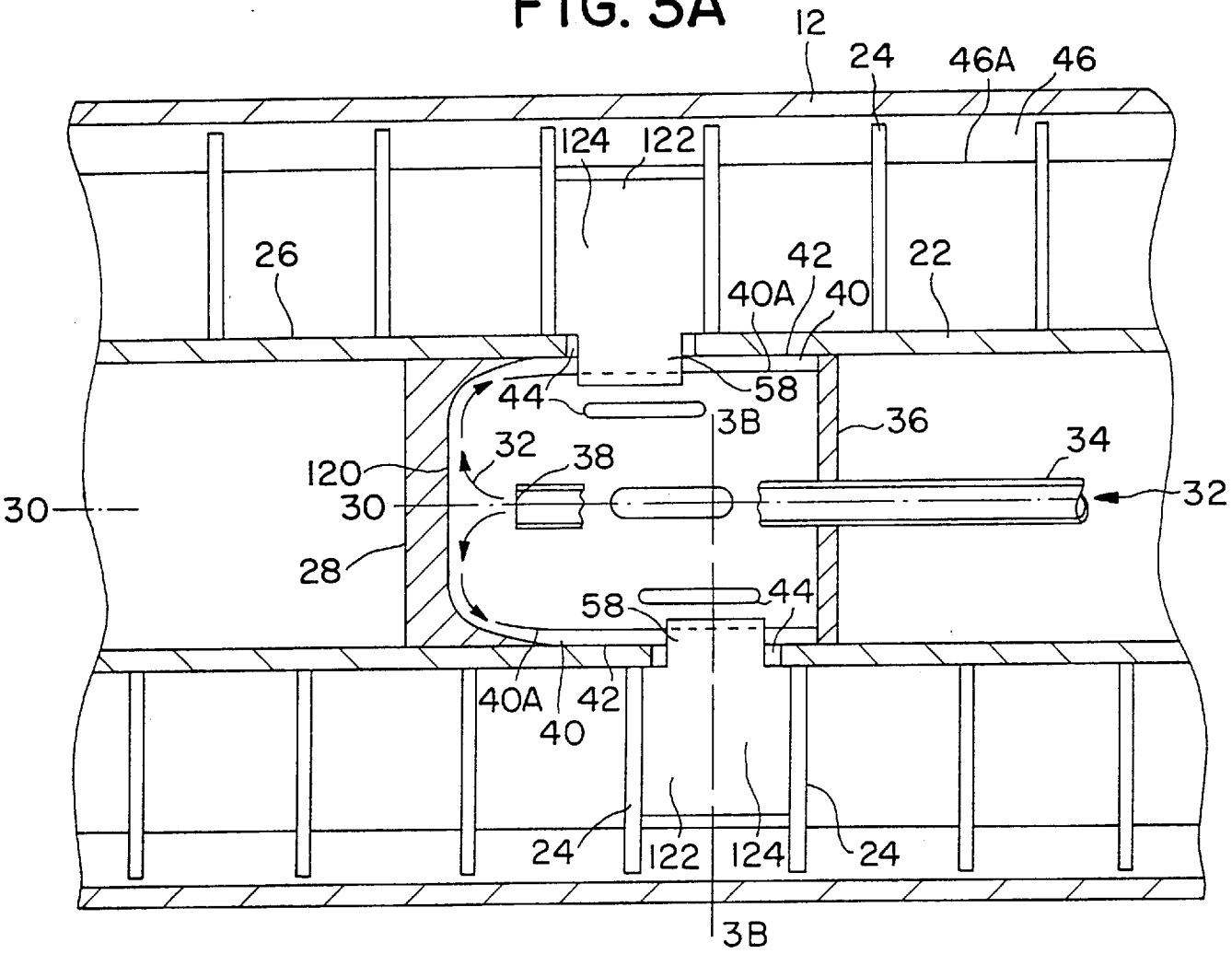
FIG. 3A is a cross-sectional view of one embodiment of a feed accelerator system of the invention including a plurality of vane apparatus.

As shown in FIG. 3A, the preferred embodiment of the invention includes a non-convex distributor surface 120 having no sharp bends or junctions, and a vane apparatus 122 associated with the passageway 44 and disposed between two adjacent turns of the helical blade 24. The vane apparatus 122 includes a baffle 58 extending radially into the slurry pool 40 formed on the inside surface 42 of the conveyor hub 26, and an accelerator vane 124 extending outwardly proximately from the passageway 44 and disposed between two successive turns of the helical blade 24. Each baffle 58 counterposes Coriolis forces acting upon the feed slurry 32 as it exits the passageway 44 while the feed slurry 32 is further accelerated by the accelerator vane 124 after exiting the passageway 44. Alternatively, the vane apparatus 122 may include only the accelerator vane 124, as shown in FIG. 4B. It is understood that the vane apparatus may be used in centrifuges including other types of distributor surfaces 120.

Figure 3B:
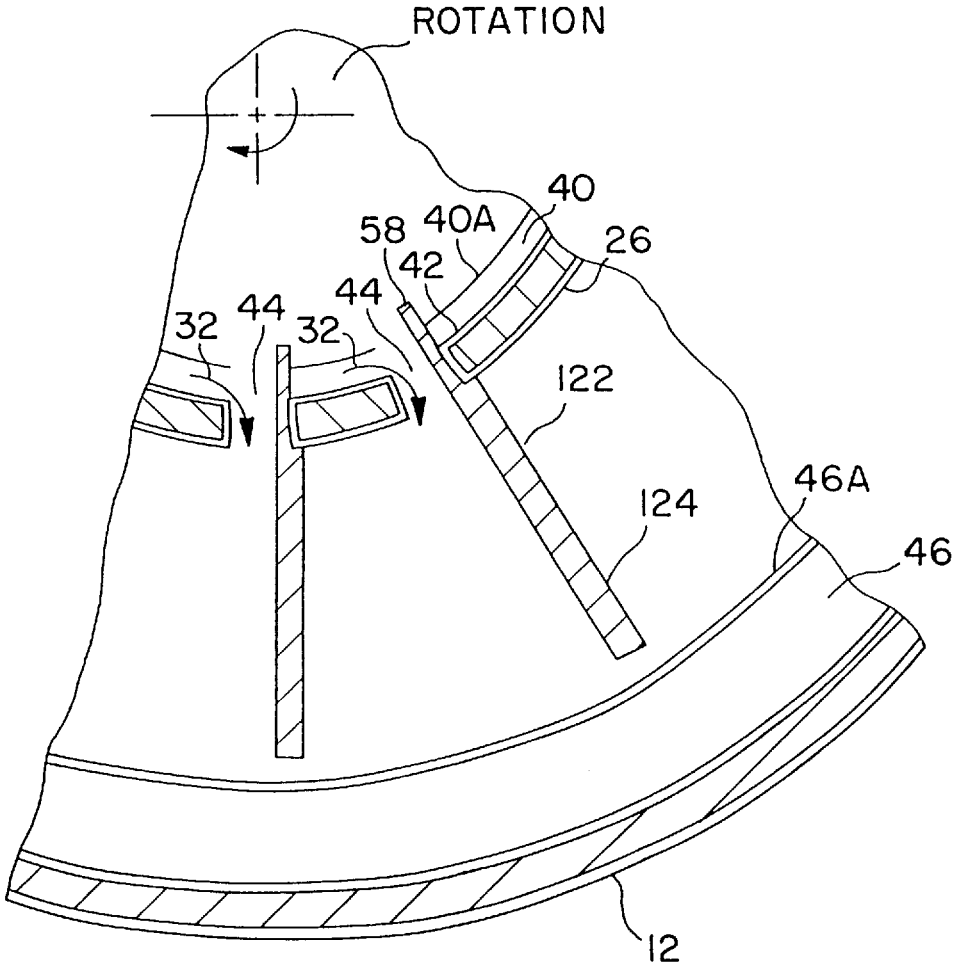
FIG. 3B is a portion of a cross-sectional view of the vane apparatus of FIG. 3A along line 3B—3B.

FIGS. 3A and 3B show the baffle 58 extending beyond the slurry pool surface 40A of the slurry pool 40. It is understood that the baffle 58 may not extend beyond the slurry pool surface 40A. FIGS. 3A and 3B also show the accelerator vane 124 proximately extending to the separation pool surface 46A of the separation pool 46. It is understood that the accelerator vane 124 may also extend into the separation pool 46.

Figure 4A:
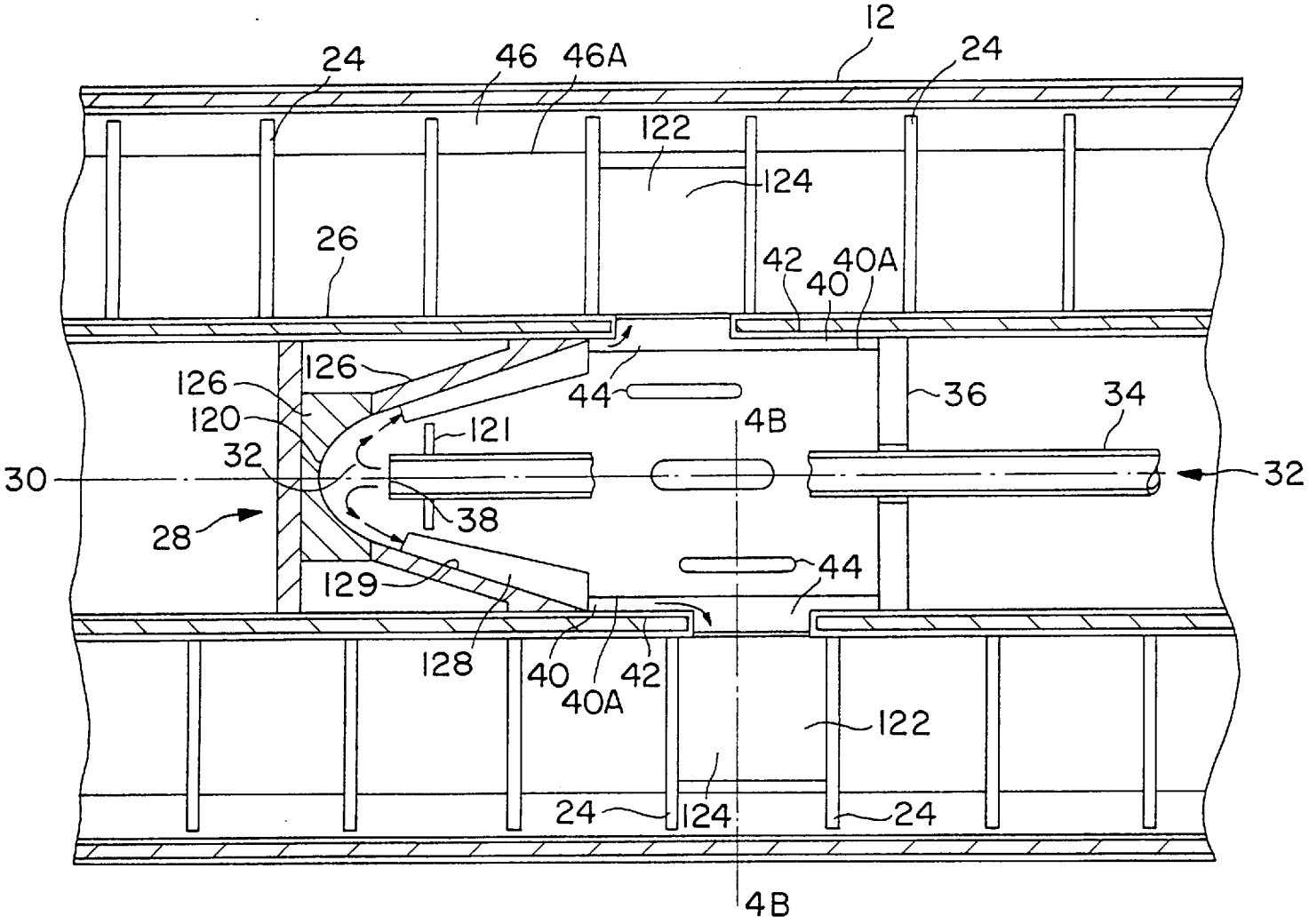
FIG. 4A is a cross-sectional view of another embodiment of a feed accelerator system of the invention including a plurality of vane apparatus.
Figure 4B:
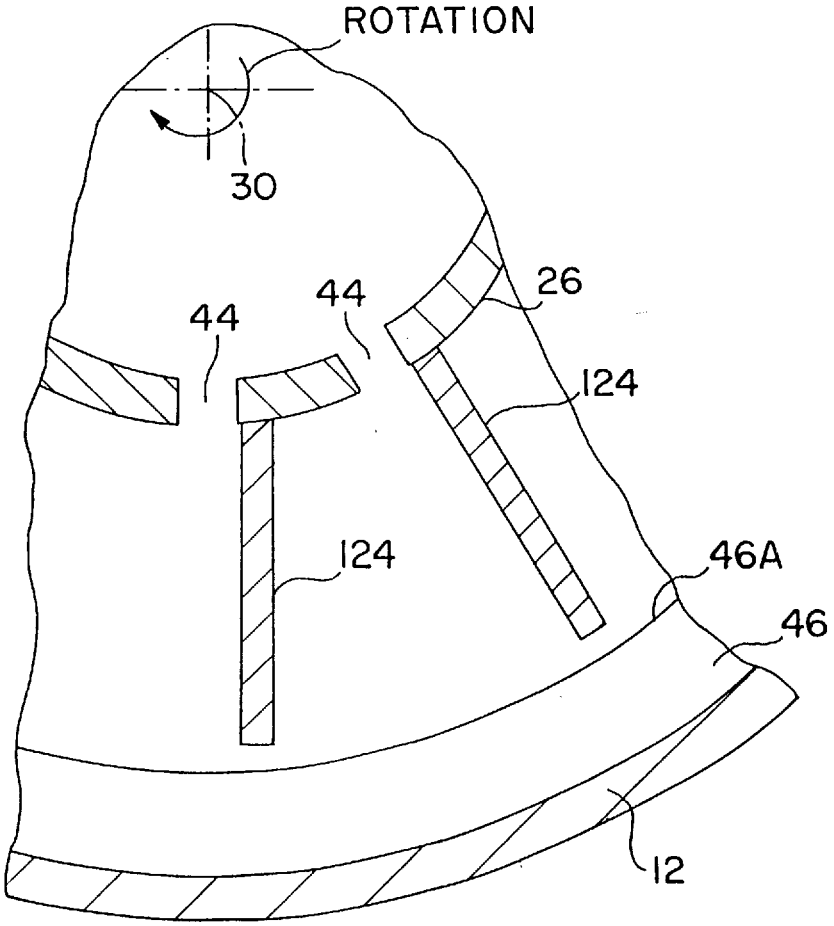
FIG. 4B is a portion of a cross-sectional view of the vane apparatus of FIG. 4A along line 4B—4B.

FIG. 4A shows an accelerator 28 and feed slurry accelerator enhancement design suitable for centrifuges having a relatively small radial distance from the outer diameter of the conveyor hub 26 to the pool surface 46A. In this embodiment, a cone-shaped accelerator 126 is secured within the conveyor hub 26 and includes a non-convex, approximately parabolic distributor surface 120 having no sharp bends or junctions, and a plurality of cone vanes 128 disposed on an inside surface 129 of the cone-shaped accelerator 126. Feed pipe baffle 121 is secured to the feed pipe 34 proximate to the discharge opening 38. Another baffle 36 is secured within the conveyor hub 26 so as to substantially prevent any feed slurry 32 from flowing back along the outside of the feed pipe 34. As shown in FIGS. 4A and 4B, the vane apparatus 122 includes an accelerator vane 124 extending outwardly proximately from each passageway 44 and disposed between two successive turns of the helical blade 24. In this embodiment, the cone vanes 128 accelerate the feed slurry 32 to the rotational speed of the conveyor hub 26, and each accelerator vane 124 further accelerates the feed slurry 32 to the rotational speed of the separation pool surface 46A after the feed slurry 32 exits the passageway 44. It is understood that the vane apparatus may also include a baffle 58 extending radially inward into the hub 26.

The conveyor hub 26 may support more than one helical blade 24, for example, a double-lead conveyor would have two helical blades 24 interleaved with one another. In such case, it is understood that in the embodiments of FIGS. 3A and 4A, the accelerator vanes 124 would extend between adjacent surfaces of the helical blades 24.

Figure 6:
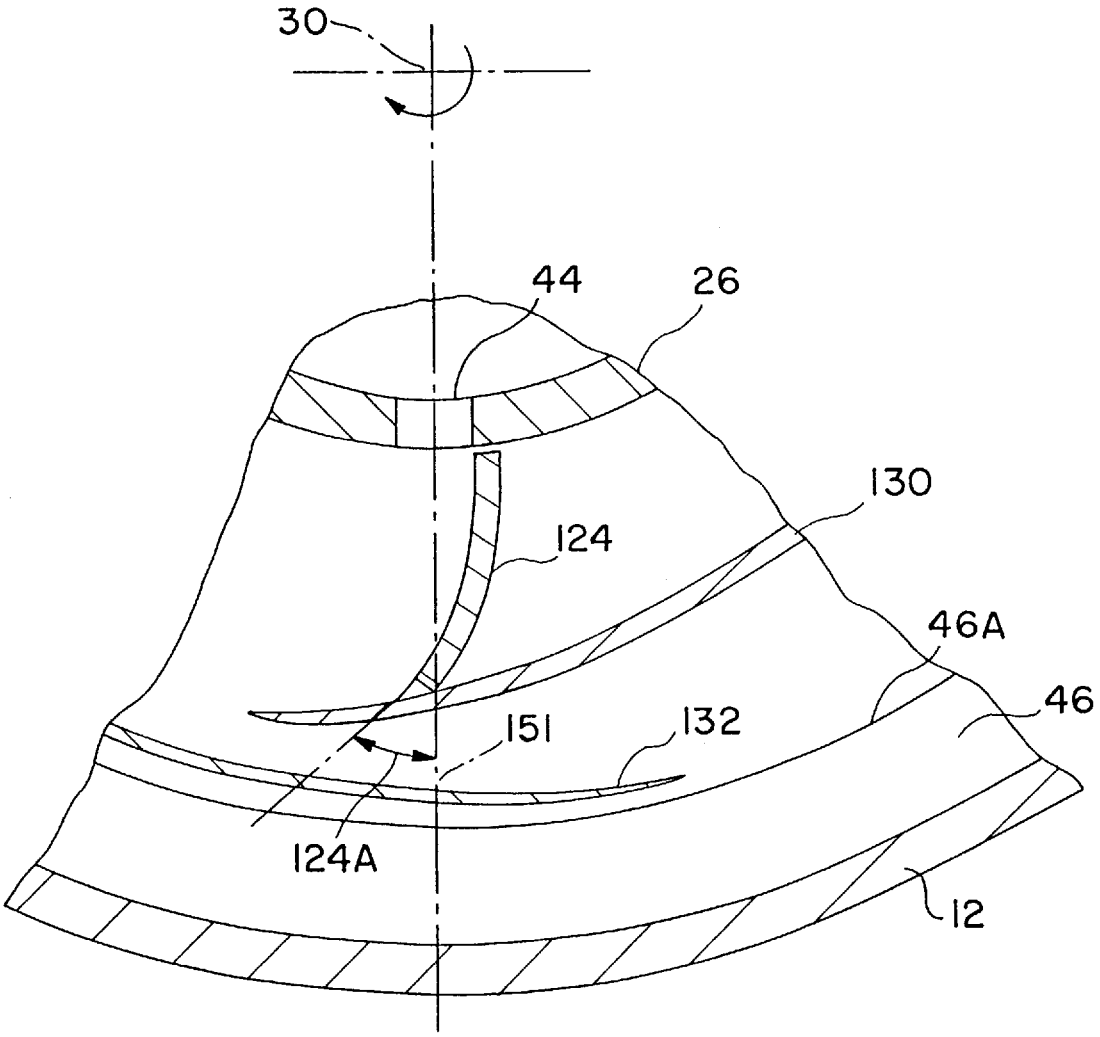
FIG. 6 is a portion of a cross-sectional view of the feed accelerator system of FIG. 5 along line 6—6.

It is noted that in either embodiments of FIGS. 3A and 4A, the baffle 58 and the accelerator vane 124 may be integral with one another. In addition, the accelerator vanes 124 may include a forward discharge angle 124A, as shown in FIG. 6, so that the feed slurry 32 exits the accelerator vanes 124 with a linear circumferential speed greater than that of the accelerator vanes 124 at their outer ends. Furthermore, the passageways 44 extend virtually the entire axial length of the space between adjacent turns of the helical blade 24, but such passageways 44 are relatively narrow in the circumferential direction. This configuration permits the use of several passageways 44 without excessive loss of strength of the conveyor hub 26, thus resulting in adequate flow area for exiting feed slurry 32 and the installation of several accelerator vanes 128 exterior to the conveyor hub 26.

Figure 5:
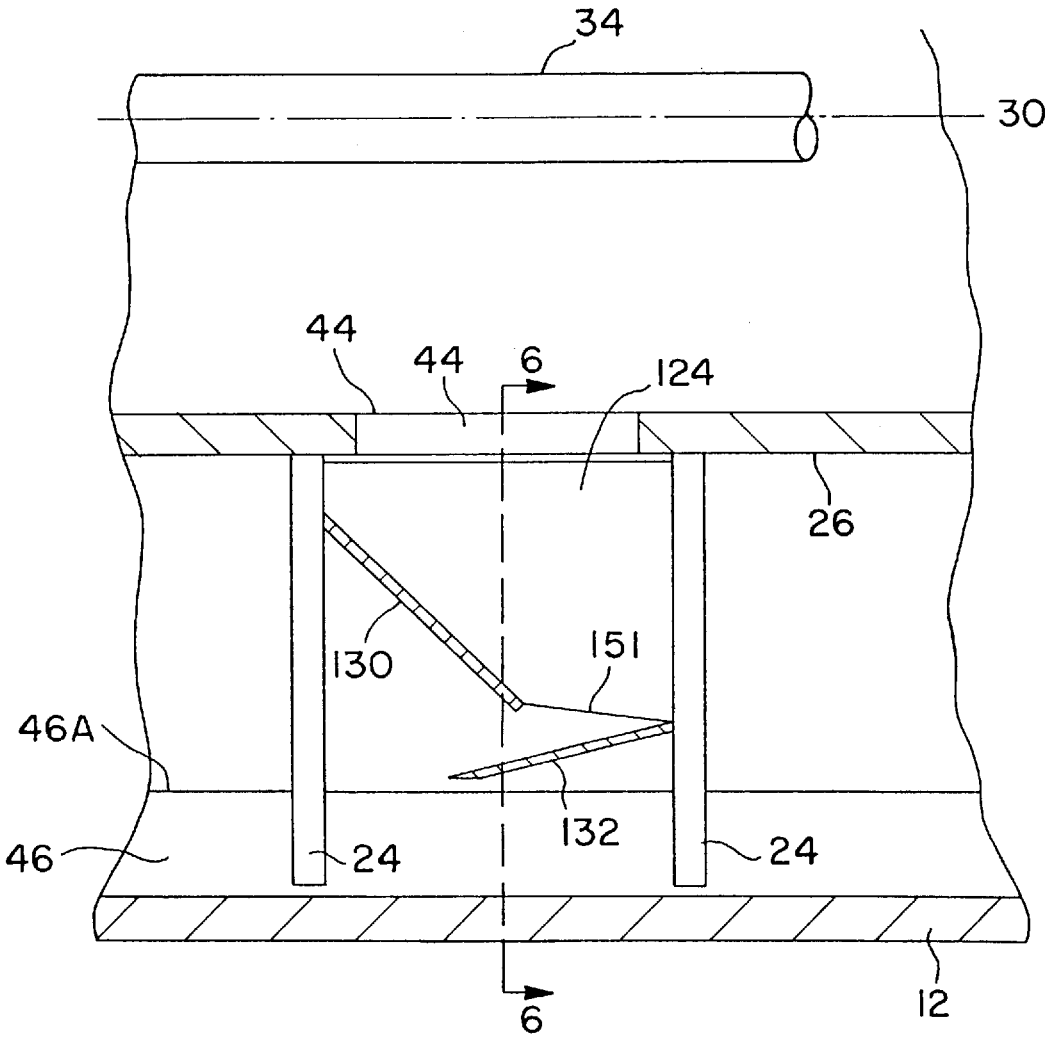
FIG. 5 is a portion of a cross-sectional view of another embodiment of a feed accelerator system of the invention including a flow guiding skirt and smoothener apparatus.

The feed slurry 32 exits the passageways 44 in concentrated streams or jets which reduce the separation efficiency of the centrifuge by causing remixing in the separation pool 46 of the separated solids 50 with the liquid 52. To eliminate such remixing, a flow guiding skirt 130 may be disposed circumferentially about the conveyor hub 26 and attached to a first turn of the helical blade 24 at an angle, as shown in FIGS. 5 and 6. A smoothener 132 is disposed in a generally circumferential manner about the conveyor hub 26 and is attached to a second turn of the helical blade 24 adjacent to the first turn at an angle so that feed slurry 32 exiting the vane apparatus 122 is directed onto the smoothener 132 by the flow guiding skirt 130. When the feed slurry 32 engages the smoothener 132, the concentrated streams or jets of the feed slurry 32 flowing outwardly along accelerator vanes 124 are smeared out circumferentially so that the feed slurry 32 enters the separation pool 46 in a substantially uniform circumferential manner, thus substantially lessening the remixing problem. The position and orientation of the flow guiding skirt 130 and the smoothener apparatus 132, and the size of the opening 151 are selected to facilitate the discharge of the accelerated feed slurry 32 without clogging of the opening 151 or the passageway 44. It is understood that the smoothener 132 may be used without the flow guiding skirt 130.

To reduce the maintenance costs of the centrifuge, the vane apparatus, flow guiding skirt and smoothener apparatus may be removable and may include a wear resistant material.

Figure 7B:
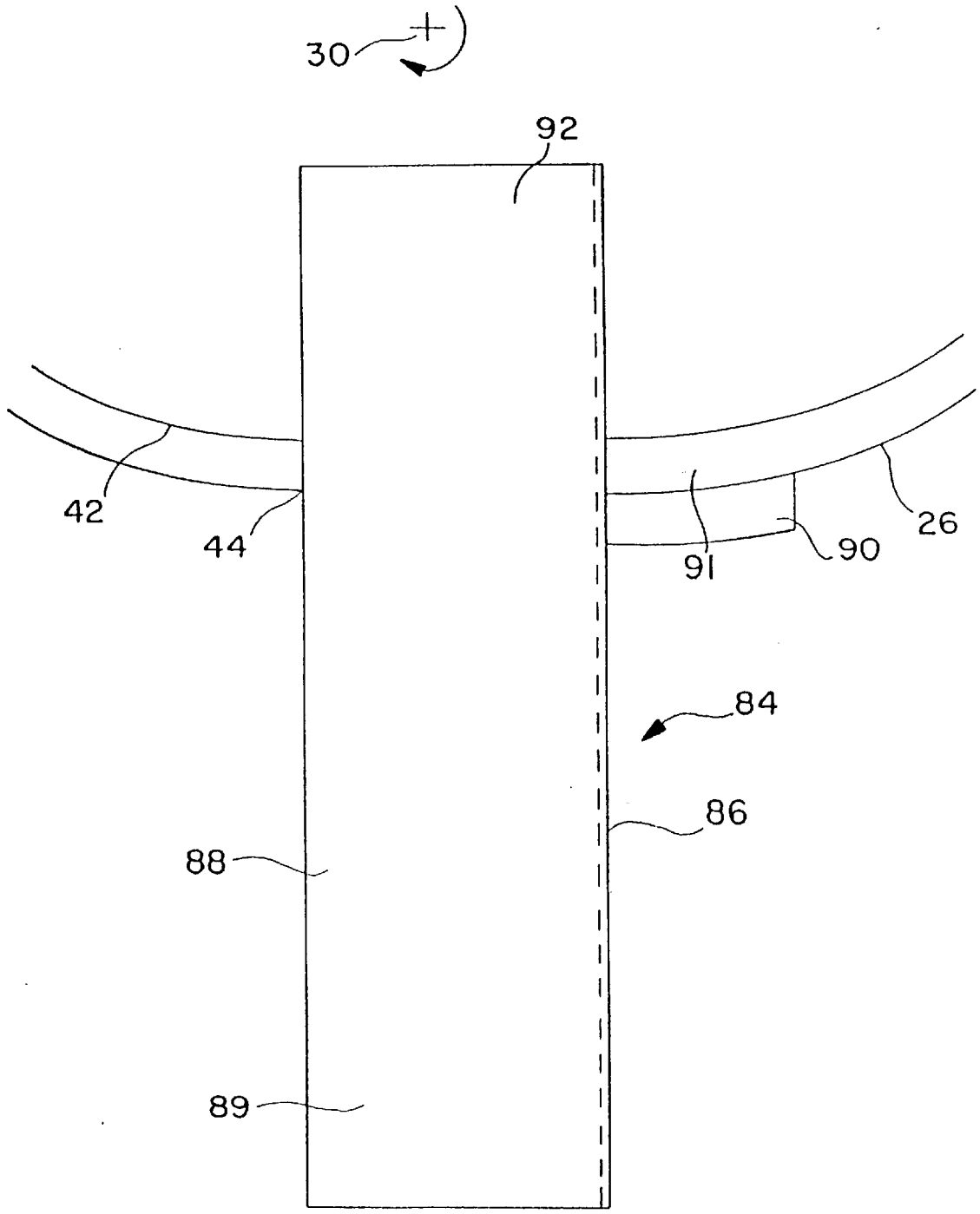
FIG. 7B is a side view of the U-shaped channel of FIG. 7A.

FIG. 7A shows another embodiment of a feed accelerator system including an extension tube, such as a generally U-shaped channel 84, extending outwardly from the passageway 44 and secured thereto by a hub tab 90 and screws 91. FIG. 7B shows a side view of the U-shaped channel 84 communicating with the passageway 44. The generally U-shaped channel 84 includes a base 86 disposed between two side walls 88. The base 86 may be generally parallel to the axis of rotation 30, and two side walls 88 may be generally perpendicular to the axis of rotation 30 of the conveyor hub 26. Alternatively, the side walls 88 may be parallel to the turns of the helical blade 24.

Additional modifications may be made to the U-shaped channel 84 to increase the linear circumferential speed of the feed slurry 32 exiting the conveyor hub 26. For example, the side walls 88 may not extend the entire length of the base 86, may taper from a wide width to a narrow width or visa versa, or may have a constant narrow width in relation to the width of the base 86. There is also the possibility that the side walls 88 and the base 86 may join in a curved manner so as to form a U-shaped channel 84 having no sharp bends or junctions. The side walls 88 may be parallel to one another and perpendicular to the base 86, as shown in FIG. 7A. Alternatively, the side walls 88 may not be parallel to one another and not perpendicular to the base 86 so as to form a generally U-shaped channel 84 having a larger or smaller exit opening than the size of the passageway 44.

In the embodiment of FIG. 7A, the U-shaped channel 84 communicates with an inwardly extending L-shaped baffle 92 which opposes the Coriolis force and directs the feed slurry 32 into the passageway 44. The U-shaped channel 84 acts as an exterior accelerating baffle of the conveyor hub 26 and is particularly useful for feed slurries that may contain large masses of solids because the open nature of the U-shaped channel 84 reduces the possibility of self-clogging and of clogging passageway 44. It is understood that the U-shaped channel 84 may be used without the L-shaped baffle 92.

Figure 8A:
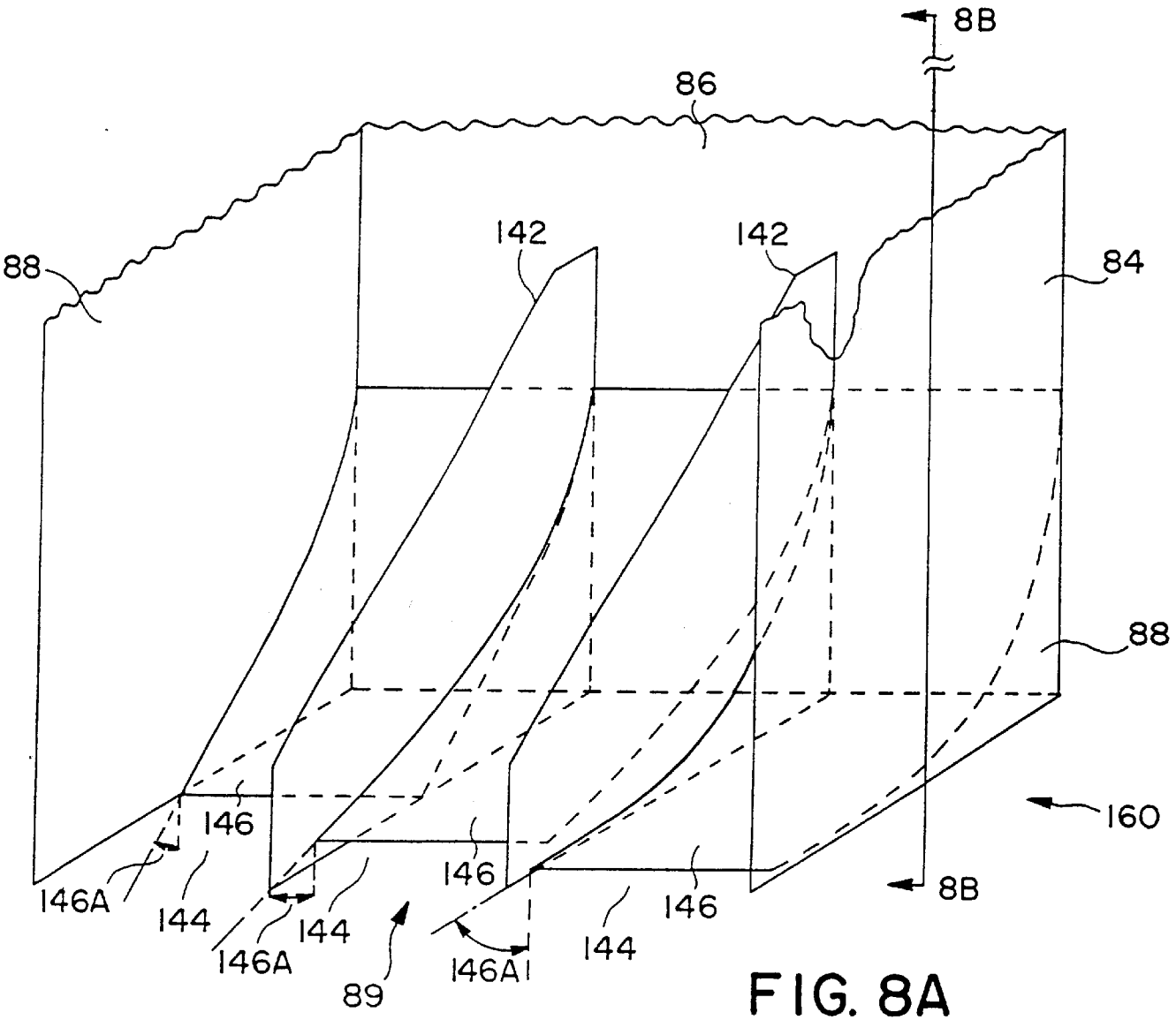
FIG. 8A is a perspective view of the discharge end of a U-shaped channel including partitions and flow directing and overspeeding vanes.

The experimental rig, as previously described, was used to study the effectiveness of the U-shaped channel 84 of FIG. 7A, in combination with a flow directing and overspeeding vane similar to one of the vanes 146 in FIG. 8A attached to the discharge end 89 of the U-shaped channel 84. Within each of the four passageways 44 was affixed a U-shaped channel 84 having a base 86 with an inside dimension of 2.625 inches and two side walls 88 each having an inside dimension of 1.625 inches. Each U-shaped channel 84 communicated with an L-shaped baffle 92 which extended into the conveyor hub 26 a distance of 1.75 inches from inside surface 42 of conveyor hub 26.

Each U-shaped channel 84 with affixed flow directing and overspeeding vane 146 extended outwardly from a passageway 44 to a radius of approximately 10.5 inches, measured from the axis of rotation 30. The acceleration efficiency was determined for various forward discharge angles 146A (measured from the radial direction), as shown in FIG. 8A, of vane 146. At a conveyor hub 26 rotational speed of approximately 2000 revolutions per minute, and with a flow rate of feed slurry 32 (modelled by water), of 400 gallons per minute, values of acceleration efficiency were determined to be as follows:

| Forward Discharge Angle (deg.) | 0 | 30 | 45 | 60 | 75 | 90 |
|---|---|---|---|---|---|---|
| Acceleration Efficiency, percent | 105 | 142 | 147 | 156 | 157 | 154 |

The results show that over a wide range of forward discharge angles 146A of vane 146, from about 30 degrees to 90 degrees, acceleration efficiencies of about 150 percent can be achieved, with maximum acceleration efficiency occurring when the forward discharge angle 146A of the flow directing and overspeeding vane 146 (or forward discharge angle 124A of vane 124 (FIG. 6) is in the range of 60 degrees to 75 degrees. The test results also show that over a wide range of forward discharge angles 146A and 124A (FIG. 6), for example 30 degrees to 90 degrees, the acceleration efficiency varies only weakly with the forward discharge angle 146A. It is noted that acceleration efficiency is here calculated at the value corresponding to the outermost radius of vane 146. Therefore, these results show that the pool surface 46A may be at a radius greater than the outermost radius of vane 146 by a factor of as much as 1.22, without causing the effective acceleration efficiency at pool surface 46A to fall below 100 percent.

Although high acceleration efficiencies may be obtained with U-shaped channels or other extension tubes having a flow directing and overspeeding vane, such configurations have disadvantages in that the feed slurry 32 is discharged into the separation pool 46 in the form of concentrated streams or jets which result in a remixing of the separated solids 50 and the separated liquids 52 in the separation pool 46, and a consequent decrease in separation efficiency.

Figure 8B:
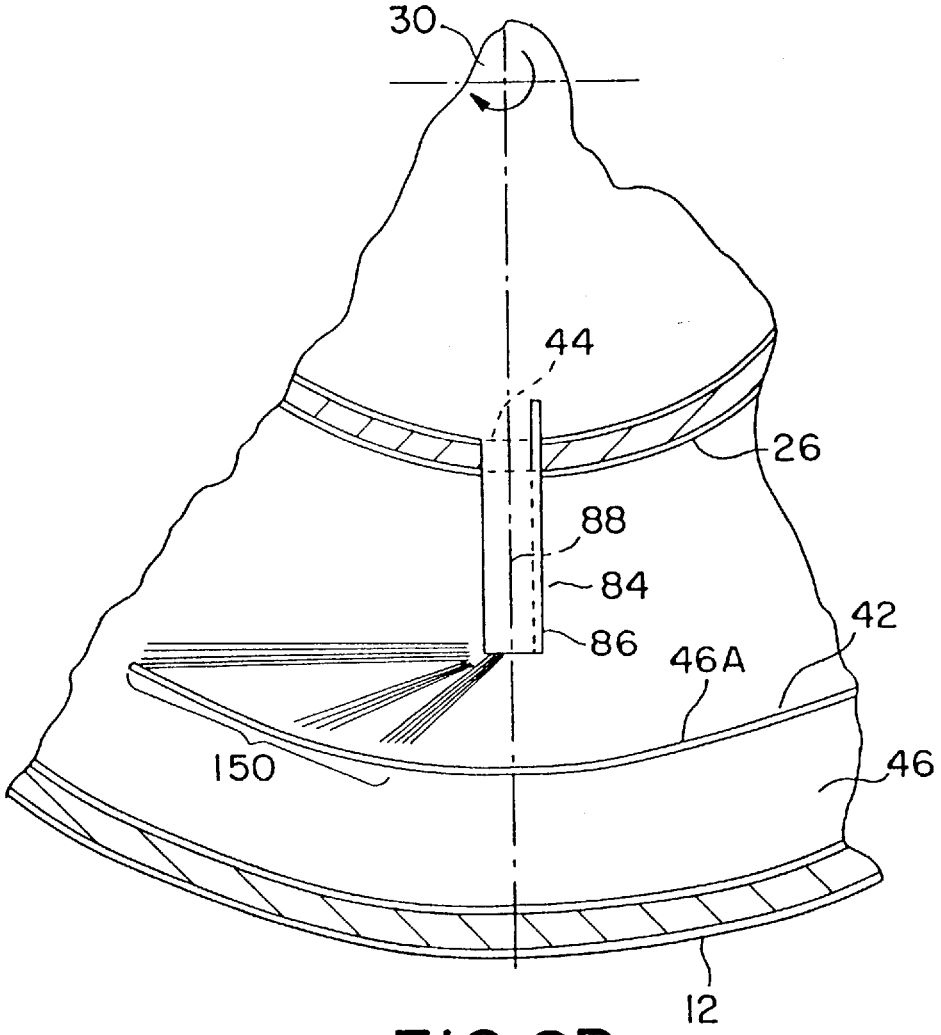
FIG. 8B is a cross-sectional view of the decanter centrifuge of FIG. 1A including the U-shaped channel of FIGS. 7A and 7B having the discharge end of FIG. 8A.

As more fully described below, this remixing problem can be substantially reduced by exploiting the aforementioned insensitivity of the acceleration efficiency to the forward discharge angle 146A of the flow directing and overspeeding vane 146. As shown in FIG. 8A, the U-shaped channel 84 is modified so that its outer end 89 is divided by a plurality of partitions 142 parallel to the side walls 88 into a plurality of discharge channels 144. Each channel 144 includes a forward-curved flow directing and overspeeding vane 146 having a different forward discharge angle 146A for each such discharge channel 144. The vanes 146 in combination-with partitions 142 form an overspeeding apparatus 160. FIG. 8B shows that the feed slurry 32 exits the U-shaped channel 84 from the outlets of the several discharge channels 144 at different angles, such as between 30 degrees and 90 degrees (measured from the radial direction), with respect to the radial direction. Accordingly, the entry position of the feed slurry 32 into the separation pool 46 is spread out circumferentially over a large arc 150, thus providing greater circumferential uniformity with an attendant reduction of remixing caused by impingement of the feed slurry 32 on the pool surface 46A of the separation pool 46.

It is understood that the overspeeding apparatus 160 may also be associated with the passageway 44. More specifically, the overspeeding apparatus 160 would include a baffle, similar to the base 86 of the U-shaped channel 84, extending outwardly from the passageway 44. The partitions 142 and 146 would extend in a circumferential direction from the baffle.

To reduce the cost of centrifuge maintenance, the vanes 146 and partitions 142 may be removable and may include a wear resistant material.

What is claimed is:

1. A feed accelerator system for use in a centrifuge, the system comprising:

a conveyor hub rotatably mounted substantially concentrically within a rotating bowl, the hub having an inside surface and an outside surface, at least one helical blade mounted to the outside surface of the conveyor hub, the blade having a plurality of turns, a feed pipe mounted substantially concentrically within the conveyor hub for delivering a feed slurry to the centrifuge, at least one feed slurry passageway between the inside surface of the conveyor hub and the outside surface of the conveyor hub, and a vane apparatus associated with the passageway and disposed between two adjacent turns of the helical blade, the vane apparatus including an accelerator vane extending outwardly from the passageway such that the accelerator vane is forwardly curved in the direction of rotation of the conveyor hub, thereby defining a feed slurry exit having a forward angle up to and including 75 degrees from a radial direction.

2. The feed accelerator system of claim 1 further comprising:

a flow guiding skirt disposed circumferentially about the conveyor hub and attached to a first turn of the helical blade at an angle; and a smoothener apparatus disposed generally circumferentially about the conveyor hub and attached to a second turn of the helical blade adjacent to the first turn at an angle so that feed slurry exiting the vane apparatus is directed onto the smoothener apparatus by the flow guiding skirt.

3. The feed accelerator system of claim 1 further comprising a smoothener apparatus disposed generally circumferentially about the conveyor hub and attached to one turn of the helical blade so that feed slurry exiting the vane apparatus impinges upon the smoothener.

4. A feed accelerator system for use in a centrifuge, the system comprising:

a conveyor hub rotatably mounted substantially concentrically within a rotating bowl, the hub having an inside surface and an outside surface, at least one helical blade mounted to the outside surface of the conveyor hub, the blade having a plurality of turns, a feed pipe mounted substantially concentrically within the conveyor hub for delivering a feed slurry to the centrifuge, at least one feed slurry passageway between the inside surface of the conveyor hub and the outside surface of the conveyor hub, and a vane apparatus associated with the passageway and disposed between two adjacent turns of the helical blade, the vane apparatus including an accelerator vane extending outwardly from the passageway such that the accelerator vane is forwardly curved in the direction of rotation of the conveyor hub, thereby defining a feed slurry exit having a forward angle between 60 and 75 degrees from a radial direction.

* * * * *